United States Patent [19]

Varisco

[11] 4,434,924

[45] Mar. 6, 1984

[54] DUAL DRIVEN FEED ROLLS FOR A PUNCH PRESS

[75] Inventor: Mario Varisco, Allison Park, Pa.

[73] Assignee: Vamco Machine & Tool, Inc., Pittsburgh, Pa.

[21] Appl. No.: 363,079

[22] Filed: Mar. 29, 1982

[51] Int. Cl.[3] ..... B65H 17/22; B65H 17/26

[52] U.S. Cl. ..... 226/120; 83/236; 226/154; 226/163

[58] Field of Search ..... 226/120–123, 226/164, 168, 181, 188, 174, 162, 163, 152–156; 74/384, 412 R, 414; 83/236, 238, 336

[56] References Cited

U.S. PATENT DOCUMENTS

| | | | |
|---|---|---|---|
| 3,758,011 | 9/1973 | Portmann | 226/142 |
| 3,784,075 | 1/1974 | Portmann | 226/143 |
| 4,032,056 | 6/1977 | Ito | 226/154 |
| 4,040,553 | 8/1977 | Gotz | 226/151 |
| 4,133,216 | 1/1979 | Gentile et al. | 74/384 |
| 4,138,913 | 2/1979 | Gentile | 83/236 |
| 4,304,348 | 12/1981 | Kato | 226/152 |

*Primary Examiner*—Leonard D. Christian

*Attorney, Agent, or Firm*—Stanley J. Price, Jr.; John M. Adams

[57] ABSTRACT

The input shaft of a punch press is rotated at a continuous preselected speed and is drivingly connected by a cam drive mechanism to an output shaft to generate oscillating rotational movement of the output shaft. Upper and lower feed rolls are rotatably supported in a frame in overlying relation to engage stock material extending between the upper and lower rolls. A combination linkage and gear cluster transmits the oscillating rotation movement of the output shaft to one of the feed rolls. The second feed roll is pivotally supported in the frame for movement toward and away from the first feed roll. A coupling drivingly connects the gear cluster to the second feed roll to oscillate the second feed roll through an angle of rotation corresponding to the angle of rotation of the first feed roll and thereby drive both of the feed rolls to intermittently feed a preselected length of the stock material to the press. The coupling is drivingly connected to the second feed roll to facilitate movement of the second feed roll toward and away from the first feed roll and as rotation is transmitted to the second feed roll.

10 Claims, 5 Drawing Figures

DUAL DRIVEN FEED ROLLS FOR A PUNCH PRESS

BACKGROUND OF THE INVENTION

1. Field of the Invention

This invention relates to apparatus for feeding stock material intermittently to a press and more particularly to press feed apparatus that includes a pair of dual driven feed rolls mounted for movement of one feed roll toward and away from the other feed roll and operable to intermittently feed stock material to a press.

2. Description of the Prior Art

In automatic punch press operations, and particularly presses that operate at high speed, a strip of stock material is fed from a coil to the dies of the press for punching, stamping, cutting or the like. A preselected length of the stock material is fed to the press after each press operation. The stock material is fed from the coil in timed relation with the press operation so that before the dies contact the stock material, the stock material is moved into a final position by the die pilots as the feed rolls are released from engagement with the stock material. The stock material is stationarily positioned between the dies during the press operation. After the press operation, the feed rolls are returned to a position engaging the stock material. The driven feed roll is then actuated to rotate through preselected angle of rotation to advance another length of the stock material to the press. The feeding of the stock material to the press must be coordinated with each press operation so that prior to each operation, a new segment of stock material is in position relative to the dies for the press operation.

U.S. Pat. Nos. 4,133,216 and 4,138,913 are examples of punch press feeding apparatus in which a driven feed roll is intermittently rotated through a 360° rotational cycle. During the rotational cycle, the driven feed roll and a idler feed roll advance a preselected length of the stock material to the press. During a dwell period of the rotational cycle, the driven feed roll is not rotated and the press operation is performed. After the press operation is completed, another preselected length of stock material is advanced to the press by the intermittent rotation of the driven feed roll.

With the above described prior art arrangement, the length of stock material incrementally advanced to the press is determined by the angle of rotation of the driven feed roll. By increasing and decreasing the angle of rotation of the driven feed roll, the feed length of the stock material to the press is adjusted. When the press operation is performed, the driven feed roll and the idler feed roll are removed from driving engagement with the stock material and the stock material is engaged by a clamp. During this interval, the driven feed roll is released from engagement with the stock material and rotated in the opposite direction of the direction of feed to return the driven feed roll to the initial feed position. Thereafter, the driven feed roll and the idler feed roll are returned to engagement with the stock material and the clamp is released.

The driven feed roll is incrementally rotated and a preselected length of the stock material is fed to the press. Movement of the stock material is transmitted to the idler roll, resulting in rotation of the idler roll. A problem frequently encountered with this arrangement is slippage of the stock material between the driven feed roll and the idler roll. One proposed solution to preventing slippage of the stock material between the rolls is increasing the clamping engagement of the feed roll and the idler roll with the stock material when the feed and idler rolls are returned to feeding engagement with the stock material. However, an additional problem is encountered when the clamping force is increased, particularly with relatively thin stock material or easily deformable stock material. Stock material of this type is susceptible to deformation and misregister of a stamping or cutting pattern. If the clamping force for relatively thin stock material is excessive, the stock material becomes elongated and the feed length for each stamping operation is not maintained uniformly. Therefore, there is need for press feeding apparatus that incrementally feeds the workpiece to the press by oscillatory movement of a pair of driven feed rolls where each roll is driven at the same degree of rotation and the rolls are movable into and out of feeding engagement with the stock material.

SUMMARY OF THE INVENTION

In accordance with the present invention, there is provided apparatus for intermittently feeding a workpiece that includes an input shaft supported for rotation at a continuous preselected speed. An output shaft has a first end portion and a second end portion. Cam drive means drivingly connecting the output shaft first end portion to the input shaft generates oscillating rotational movement of the output shaft through a preselected angle of rotation. Feed means intermittently feeds a preselected length of the workpiece in a selected direction. The feed means includes a first feed roll and a second feed roll. A frame supports the first and second feed rolls in overlying relation to engage the workpiece therebetween. Rotation transmission means is drivingly connected at one end to the output shaft second end portion and at the opposite end to the first feed roll. The rotation transmission means is operable to transmit the oscillating rotational movement of the output shaft to the first feed roll to oscillate the first feed roll through a preselected angle of rotation. Pivot means supports the second feed roll in the frame for movement toward and away from the first feed roll. Coupling means drivingly connects the rotation transmission means to the second feed roll to oscillate the second feed roll through an angle of rotation corresponding to the angle of rotation of the first feed roll and thereby drive both the first and second feed rolls. The coupling means is drivingly connected to the second feed roll to facilitate the movement of the second feed roll toward and away from the first feed roll and transmit rotation to the second feed roll.

The first and second feed rolls are nonrotatably connected to shafts that are, in turn, rotatably supported in a machine frame. The shaft of the first feed roll is stationarily positioned for rotation in the machine frame. The shaft for the second feed roll is drivingly connected to one element of the coupling means and is rotatably supported within a movable frame that is connected to the main frame for pivotal movement of the movable frame to move the second feed roll toward and away from the first feed roll.

The oscillatory rotational movement generated by the cam drive means is transmitted through a combination linkage and gear cluster to the shaft of the first feed roll. An arrangement of gears drivingly connects the first feed roll shaft to a shaft of the coupling means. The shaft of the coupling means is rotatably supported in the main machine frame and transmits the oscillating rotational movement through the coupling neans to the second feed roll shaft to oscillate the second feed roll through the same angle of rotation of the first feed roll. The coupling means permits the second feed roll to be moved toward and away from the first feed roll while maintaining the first and second feed rolls drivingly connected so that the oscillating rotational movement transmitted to the first feed roll is transmitted to the second feed roll as the second feed roll is moved into and out of feeding position.

The linkage of the cam drive means is connected by a gear cluster or directly to the shaft of the first feed roll. The linkage connection is adjustable to vary the length of travel of the linkage connection to the first feed roll to adjust the angular displacement of the first feed roll as it is rotated through a preselected angle of rotation to feed a preselected length of the workpiece to the press. A change in the angular displacement of the first feed roll for the feeding operation effects the corresponding adjustment in the angular displacement of the second feed roll. The oscillating rotational movement transmitted to the first feed roll input shaft is transmitted to the shaft of the coupling means which is drivingly connected to the second feed roll input shaft. In this manner, a single adjustment to the drive linkage effects equal adjustments in the angular displacements of the first and second feed rolls to maintain the angular displacements of the feed rolls in register.

Accordingly, the principal object of the present invention is to provide apparatus for intermittently feeding a workpiece by oscillating rotational movement of a pair of driven feed rolls through a preselected angle of rotation corresponding to a selected feed length.

Another object of the present invention is to provide a cam feed for intermittent feeding of a selected length of stock material to a power actuated press in which the stock material is positively driven by a pair of driven feed rolls being adjustable by a single control to vary the length of the stock material fed to the press.

A further object of the present invention is to provide, in a cam feed operated press, a pair of driven feed rolls mounted in a support frame to permit oscillating rotational movement transmitted to the feed rolls as the feed rolls are moved into and out of feeding engagement with the workpiece.

These and other objects of the present invention will be more completely disclosed and described in the following specification, the accompanying drawings and the appended claims.

DESCRIPTION OF THE PREFERRED EMBODIMENT

Figure 1:
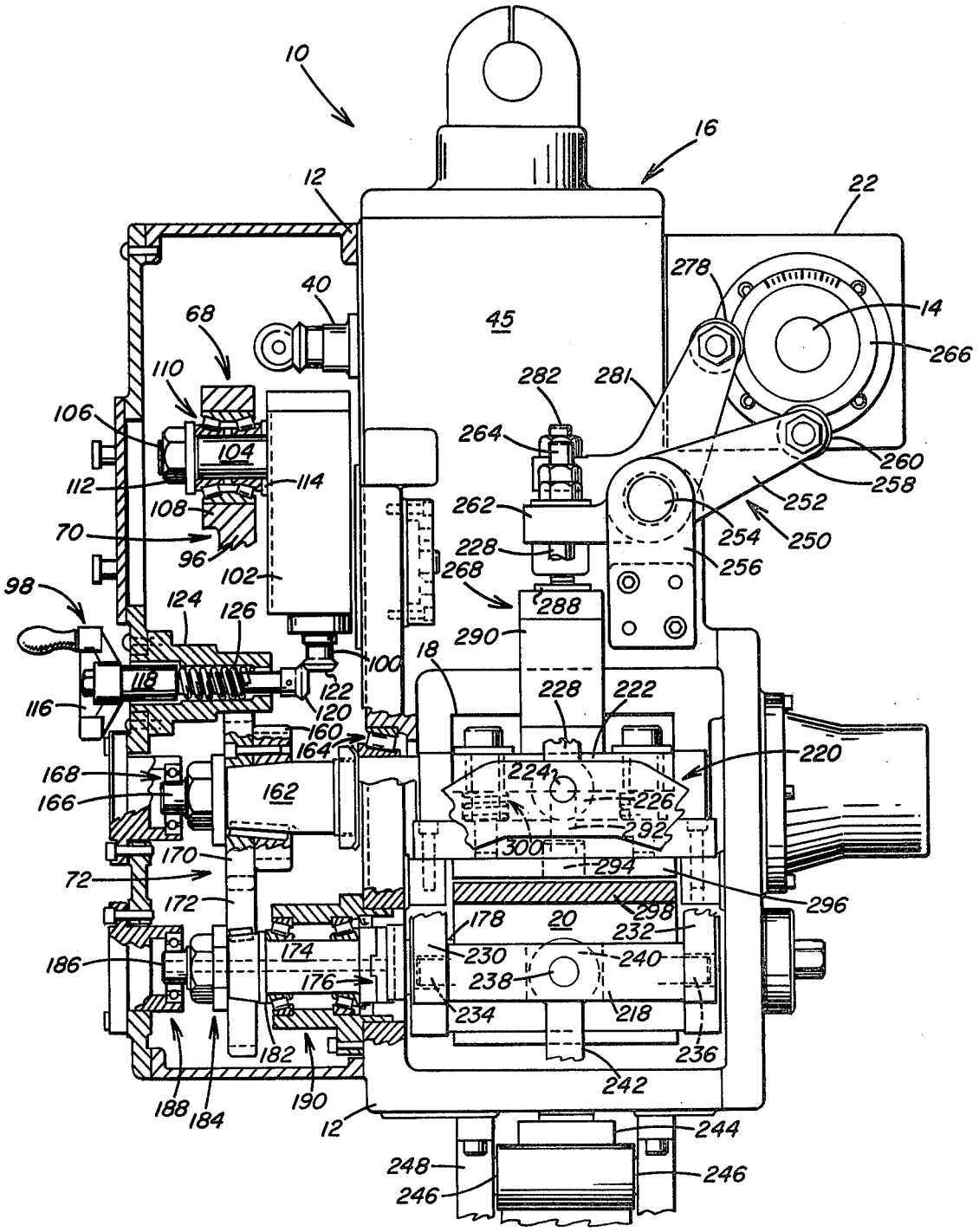
FIG. 1 is a partial, sectional, fragmentary view, in side elevation of a cam feed apparatus for transmitting oscillating rotational movement to a pair of overlying feed rolls mounted for movement into and out of feeding engagement with a workpiece as rotational movement is transmitted to the feed rolls.

Referring to the drawings and particularly to FIG. 1, there is illustrated apparatus generally designated by the numeral 10 for feeding a workpiece, such as continuous stock material, from a reel to a power operated press to perform one of a variety of press operations, such as stamping, punching, cutting or the like, of a preselected length of material from the continuous stock. The apparatus 10 includes a housing 22 for supporting a continuously rotating input shaft 14. The input shaft 14 is drivingly connected to a crankshaft (not shown) of the press in a suitable manner, as illustrated in U.S. Pat. No. 4,138,913. Rotation of the crankshaft is transmitted to the input shaft 14 to rotate the input shaft 14 at a continuous preselected speed.

The continuous rotation of the input shaft 14 is transmitted by a cam feed mechanism, generally designated by the numeral 16 to an upper feed roll 18 and a lower feed roll 20 to rotate the driven feed rolls 18 and 20 in an oscillatory manner through a preselected angle of rotation to advance a preselected length of the stock material at a preselected speed to a press where the stock material is punched, stamped, cut or the like. The driven feed rolls 18 and 20 are positioned in overlying relation with the stock material positioned therebetween. The rotary motion of the input shaft 14 is converted by the cam feed mechanism 16 to generate noncontinuous, intermittent, oscillating rotation of both the feed rolls 18 and 20 through a selected degree of rotation to intermittently feed a preselected length of the stock material to the press.

Figure 2:
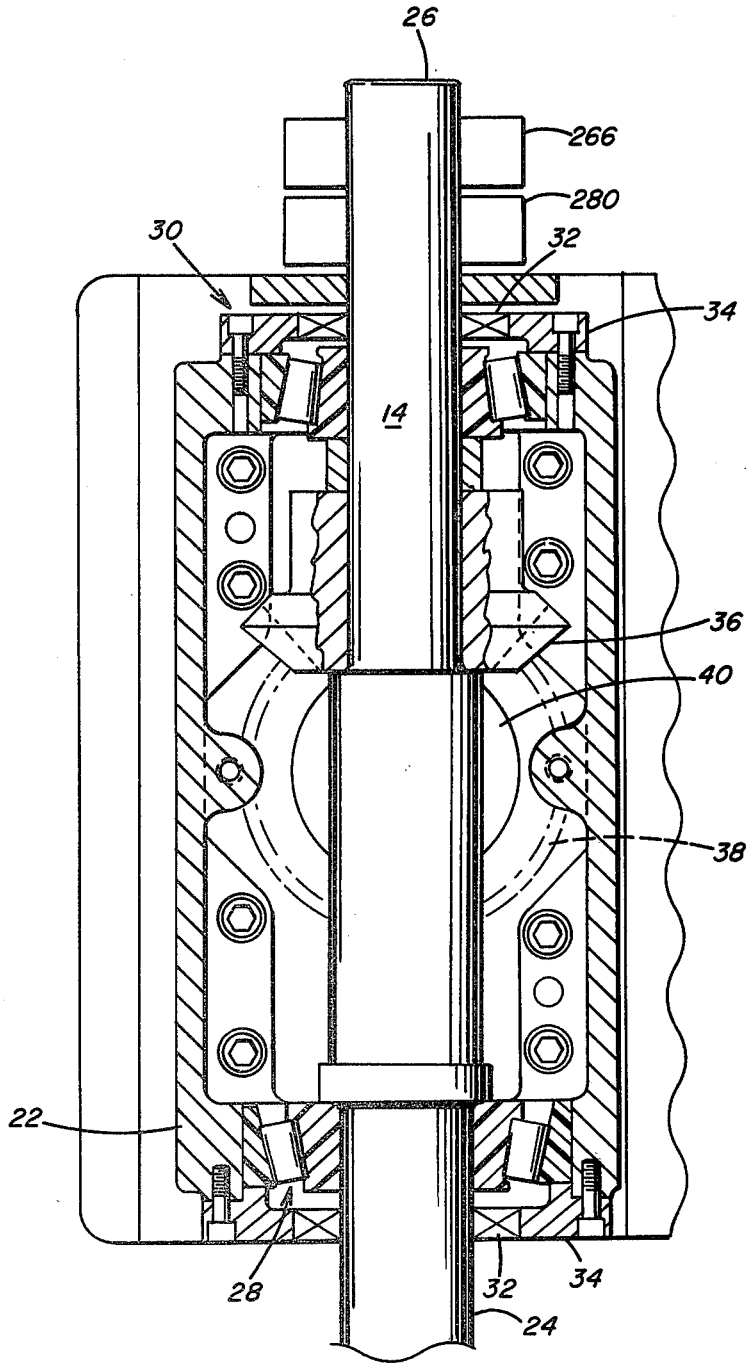
FIG. 2 is an enlarged, fragmentary, sectional view, illustrating the connection of a continuously rotated input shaft to the cam feed apparatus.

Referring to FIG. 2, the input shaft 14 is rotatably supported in a housing 22 at its end portions 24 and 26 by bearing assemblies 28 and 30 respectively. Bearing assemblies 28 and 30 are sealed within the housing 20 by oil seals 32 and caps 34 bolted to the housing 22. The input shaft 14 is continuously rotated at a preselected speed by a press crankshaft (not shown) drivingly connected to the shaft end portion 24.

Figure 4:
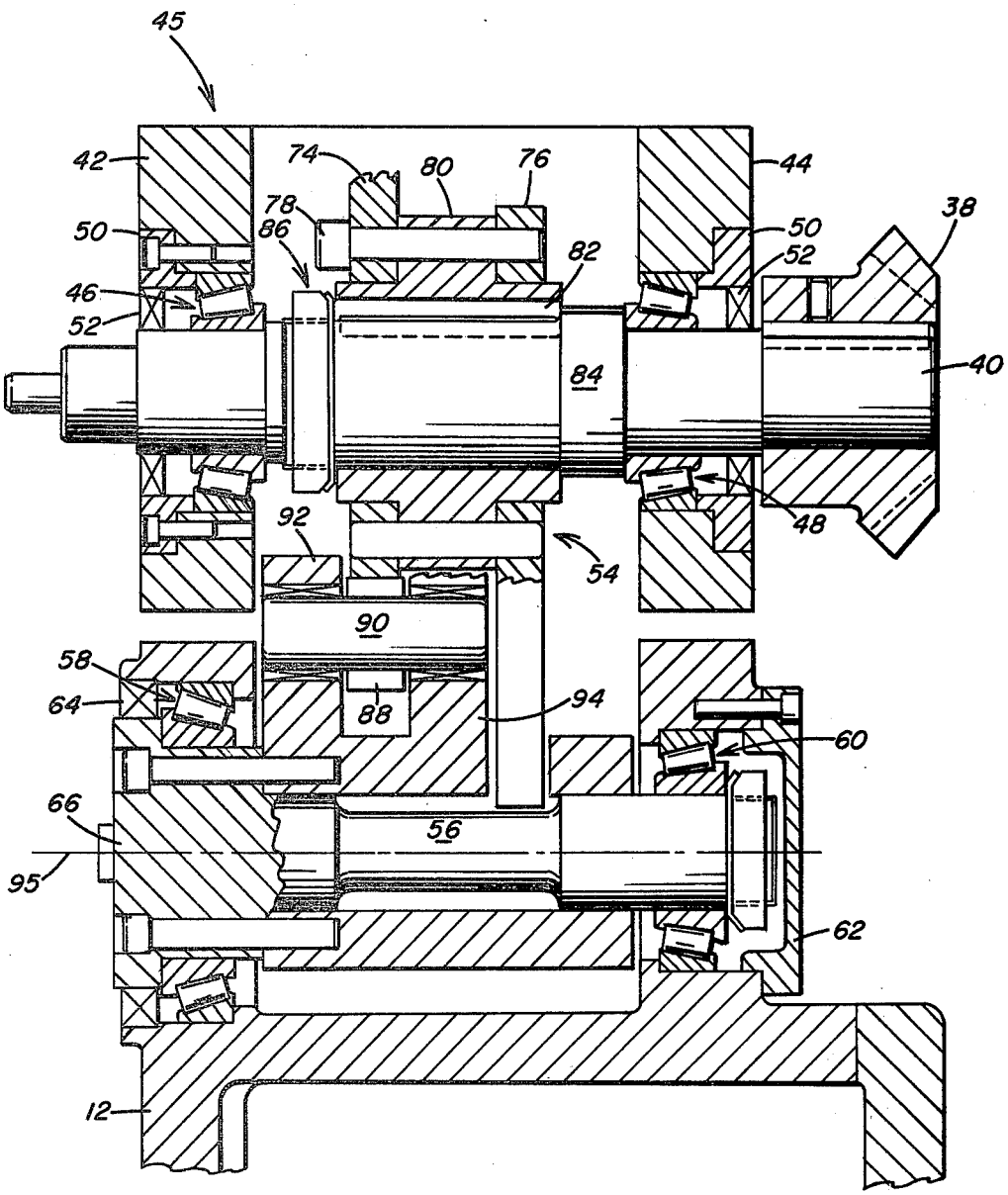
FIG. 4 is an enlarged, fragmentary, sectional view, in side elevation, of a cam and cam follower arrangement for transmitting oscillatory motion to an output shaft of the cam feed apparatus.

The input shaft 14 is drivingly connected by a pair of meshing bevel gears 36 and 38 to a cam shaft 40. The bevel gear 36 is nonrotatably connected to the input shaft 14, and the bevel gear 38 is nonrotatably connected to the cam shaft 40, as illustrated in FIG. 4. The cam shaft 40 is rotatably supported in housing frame members 42 and 44 of a cam housing 45 by bearing assemblies 46 and 48. Each of the bearing assemblies 46 and 48 are held in place by caps 50 bolted to the frame members 42 and 44 and are surrounded by seals 52 positioned between the shaft 40 and the caps 50. The shaft 40 is continuously rotated at a preselected speed.

The continuous rotation of the shaft 40 is converted by a cam drive mechanism generally designated by the numeral 54 to oscillating rotation movement of a cam follower shaft 56. The cam follower shaft 56 is rotatably supported in the main housing 12 at its end portions by bearing assemblies 58 and 60 which are held in place by cover plates 62 and sealed by seals 64. The cam follower shaft 56 includes an end portion 66 that is connected in a manner not shown in FIG. 4 to a transfer arm of a linkage adjustment assembly generally designated by the numeral 68 in FIG. 1. The linkage adjustment assembly 68 is operable to transmit the oscillatory movement of the cam follower shaft 56 through a linkage assembly generally designated by the numeral 70 and a gear cluster 72, illustrated in FIG. 1 and in FIG. 3 to the upper feed roll 18 and therefrom to the lower feed roll 20.

The cam drive mechanism 54 illustrated in FIG. 4 includes a pair of radial cam 74 and 76 connected by a pin 78 to a cam hub 80 nonrotatably connected by a key 82 to the central portion of the cam shaft 40. The cam hub 80 is maintained in a fixed axial position on the cam shaft 40 by a shaft collar 84 and a combination lock nut-washer 86. The cams 74 and 76 have a preselected configuration to convert the continuous rotation of the cam shaft 40 to oscillating rotational movement of the cam follower shaft 56. The surfaces of the cams 74 and 76 engage the surfaces of a pair of cam rollers 88 (only one of which is shown in FIG. 4). Each of the cam rollers 88 is nonrotatably mounted on a roller pin 90 that is rotatably journaled in a yoke 92 of a cam follower 94 that is, in turn, nonrotatably connected to the cam follower shaft 56. The cam roller 88 rotates as it moves on the surface of the cam 74.

In a similar arrangement, the peripheral surface of the cam 76 engages a cam roller (not shown) which is also retained on a roller pin rotatably mounted in another yoke (not shown) similar to the yoke 92 and also forming part of the cam follower 94. Thus, the yokes 92 maintain the cam rollers 88 in contact with the peripheral surfaces of the cams 74 and 76. Each of the cams 74 and 76 has a corresponding configuration to generate oscillating rotational movement of the cam follower 94 to, in turn, oscillate the cam follower shaft 56 through a preselected angle of rotation. As for example, the cam rollers 88 follow the surfaces of the cams 74 and 76 during one revolution of the cam shaft 40, the cam follower 94 rotates from an initial position through a preselected angle, as for an example, an angle of 60°.

The yokes 92 and the cam follower shaft 56 stop during a first dwell period of rotation of the cams 74 and 76 and then resume rotation in the opposite direction through a corresponding angle, as for example, an angle of 6O°. The yokes 92 and the cam follower shaft 56 return to their initial starting positions and are stopped during a second dwell period of rotation of the cams 74 and 76. By providing the pair of cams 74 and 76, the inertia of the moving stock material generated by acceleration of the stock material from an initial rest position to a maximum feed rate and then decelerating the stock material from the maximum feed rate to the rest position is compensated to maintain constant contact between the cams 74 and 76 and the cam rollers 88 of the cam follower 94. This arrangement assures zero backlash during each rotational cycle. The cam follower yokes 92 and the cam follower shaft 56 oscillate from an initial position through a preselected angle and then back through the same angle to the initial position upon each revolution of the cams 74 and 76. Thus, as the cams 74 and 76 continuously rotate, the cam follower 94 and the cam follower shaft 56 oscillate back and forth through a preselected angle. At the end of each angle of rotation, the cam follower 94 and the cam follower shaft 56 experience a dwell period in which the cam follower 94 and the cam follower shaft 56 do not move.

Figure 3:
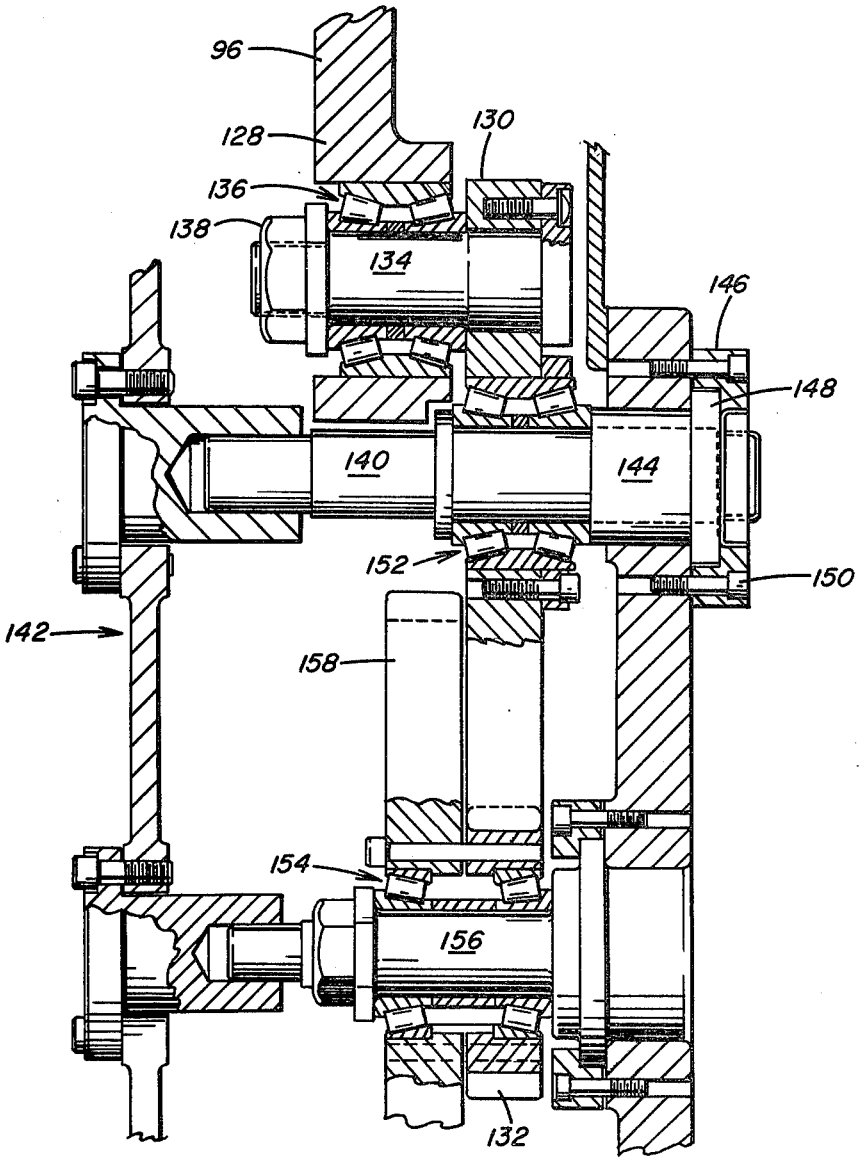
FIG. 3 is an enlarged, partial, sectional view in side elevation of a connecting link and gear cluster for transmitting oscillatory rotational movement to the pair of driven feed rolls.

The oscillating rotational movement of the cam follower shaft 56 is transmitted by the linkage assembly 70 illustrated in FIG. 1 and in further detail in FIG. 3 to both the upper and lower driven feed rolls 18 and 20. The cam follower shaft 56 is connected to the linkage assembly 70 by the linkage adjustment assembly 68 illustrated in FIG. 1. The details of the linkage adjustment assembly 68 are beyond the scope of the present invention and, therefore, will not be discussed in detail herein. A linkage adjustment assembly adaptable for use with the present invention is illustrated and described in U.S. Pat. No. 4,316,569. Preferably, the linkage adjustment assembly 68 includes a transfer arm (not shown) that overlies the axis of rotation 95 of the cam follower shaft 56 shown in FIG. 4. The transfer arm supports a slide block (not shown) that is connected to one end of a drive link 96 of the linkage assembly 70 as illustrated in FIG. 1. The opposite end of the drive link 96 is connected to the gear cluster 72 illustrated in FIG. 1. The slide block of the transfer arm is longitudinally movable in a direction perpendicular to the axis of rotation 95 of the cam follower shaft 56. The slide block is movable longitudinally on the transfer arm by rotation of an actuating device generally designated by the numeral 98 in FIG. 1. The actuating device includes an adjusting screw 100 that is rotatably supported in a housing 102 mounted to the main housing 12. The adjusting screw 100 is restrained from axial movement relative to the transfer arm and is connected thereto so that rotation of the adjusting screw 100 in a preselected direction moves the slide block on the transfer arm to a preselected position relative to the axis of rotation 95 of the cam follower shaft 56.

Further as illustrated in FIG. 1, a shaft 1O4 having a threaded end 106 extends outwardly from the slide block (not shown) and, therefore, is longitudinally movable with the slide block in a direction perpendicular to the axis of rotation 95 of the cam follower shaft 56. An end portion 108 of the drive link 96 is supported on the shaft 104 by a bearing assembly 110. The drive link end portion 108 is retained on the shaft 104 by a combination nut and washer 112 that threadedly engages the shaft threaded end 108. The nut 112 tightly engages the threaded end 106 to urge a clamp washer 114 into frictional engagement with the transfer arm to thereby retain the slide block in a preselected position on the transfer arm relative to the rotational axis of the cam follower shaft 56.

To make adjustments in the feed length, the nut 112 is loosened on the shaft threaded end 106 to remove the clamp washer 114 from frictional engagement with the transfer arm. The adjusting screw 100 is then rotated in a preselected direction by the actuating device 98 which includes a hand wheel 116 nonrotatably connected to the end of a shaft 118 that is, in turn, drivingly connected by meshing gears 120 and 122 to the adjusting screw 100. The shaft 118 is supported in a block 124 connected to the main housing 12, and a spring 126 surrounds the shaft 118 abutting, at its end portions, the enlarged end of the shaft 118 and a shoulder on the block 124. Thus, with this arrangement, by exerting an axial force upon the hand wheel 116, the spring 126 is compressed and the gears 120 and 122 are urged into meshing relation so that rotation of the hand wheel 116 is transmitted to the adjusting screw 100.

Rotation of the adjusting screw 100 moves the slide block together with the shaft 104 to a preselected position with respect to the rotational axis 95 of the cam follower shaft 56. Once the shaft 104 has been moved to the desired position corresponding to a preselected feed length, the nut 112 is tightened on the shaft threaded end 106. Tightening the nut 112 retains the drive link end portion 108 in the selected position relative to the rotational axis 95 of the cam follower shaft 56.

The drive link 96 includes a lower end portion 128, as illustrated in FIG. 3, connected to the gear segment 130. The gear cluster 72 transmits the oscillating rotational movement generated by the cam follower shaft 56 to both the upper and lower driven feed rolls 18 and 20. In this manner both feed rolls 18 and 20 are rotated through a preselected angle corresponding to a preselected feed length of the stock material fed to the press.

The length of travel of the drive link 96 generated by the oscillating rotational movement of the cam follower shaft 56 is adjustable, as explained above, to provide a preselected degree of rotation of both driven feed rolls 18 and 20 corresponding to a preselected feed length as a result of the fixed angular rotation of the cam follower shaft 56. The length of travel of the drive link 96, and accordingly, the degree of rotation of the driven rolls 18 and 20 and the resultant feed length increases with an increase in distance between the connection of the drive link first end portion 108 on the shaft 104 and the rotational axis 95 of the cam follower shaft 56. For example, to reduce the feed length, the shaft 104 together with the drive link end portion 108 is moved to a position closer to the cam follower shaft rotational axis 95. Thus, the feed length of the stock material to the press is substantially, infinitely adjustable between the limits of the longitudinal movement of the shaft 104 by rotation of the hand wheel 116 and adjusting screw 100.

As illustrated in FIG. 3, the drive link lower end portion 128 is eccentrically connected adjacent to the periphery of a drive gear segment 130 having gear teeth only on a radial segment of the gear 130. The drive gear segment 130 meshes with teeth of a gear 132. However, it should be understood that the drive gear 130 may have gear teeth around its entire periphery. The drive gear segment 130 is connected by a pin 134 to the drive link lower end portion 128. The pin 134 is rotatably supported by a bearing assembly 136 on the link end portion 128, and a nut 138 engages the threaded end of the pin 134 to retain the link end portion 128 fixed on the pin 134.

The drive gear segment 130 is mounted on a support shaft 140 in a gear case frame generally designated by the numeral 142 to permit movement of the drive gear segment 130 relative to the gear 132 and thereby allow adjustments to be made in the meshing engagement of the gear teeth of gears 130 and 132. The gear support shaft 140 includes an eccentric end portion 144 positioned within the gear case frame 142 and retained therein by a clamp ring 146. The clamp ring 146 engages an enlarged diameter portion 148 of shaft 140. A pair of screws 150 engage the clamp ring 146 to the gear case frame 142. When the shaft eccentric end portion 144 is clamped in position by the ring 146, the end portion 144 is nonrotatably retained in the gear case frame 142. By loosening the screws 150, the entire shaft 140 can be rotated. The shaft 140 is rotatably retained on the drive gear segment 130 by a bearing assembly 152. With this arrangement, any backlash existing between the meshing gears 130 and 132 can be removed by loosening the clamp ring 146 to permit rotation of the gear support shaft 40 until the respective meshing gear teeth are engaged in a manner free of backlash. Tightening the clamp ring 146 against the shaft enlarged diameter portion 148 maintains the gears 130 and 132 in the desired meshing relation. By removing backlash and play between the meshing gears 130 and 132, lost motion is removed in the transmission of rotation from the linkage assembly 70 to the pair of driven feed rolls 18 and 20.

The gear 132 is rotatably supported by a bearing assembly on a gear cluster shaft 156 securely mounted at its end portions within the gear case frame 142. Also rotatably positioned on the gear cluster shaft 156 is a gear 158 that meshes with a gear 160, illustrated in FIG. 1, mounted on a shaft 162 of the upper feed roll 18. In this manner, the upper feed roll 18 is drivingly connected to the drive link 96. A set of four meshing gears are illustrated for completing the drive connection from the drive link 96 to the upper feed roll 18 and it should be understood that other combinations of meshing gears may be utilized, for example, a set of two meshing gears as opposed to four meshing gears.

The upper feed roll support shaft 162 is rotatably mounted by a pair of bearing assemblies 164 (only one of which is shown in FIG. 1) in the main housing 12. The shaft 162 also includes an outer end portion 166 that is rotatably supported by a bearing assembly 168 in the gear case frame 142. The upper feed roll 18 is nonrotatably connected to the shaft 162 so that rotation of the shaft 162 rotates the upper feed roll 18.

Figure 5:
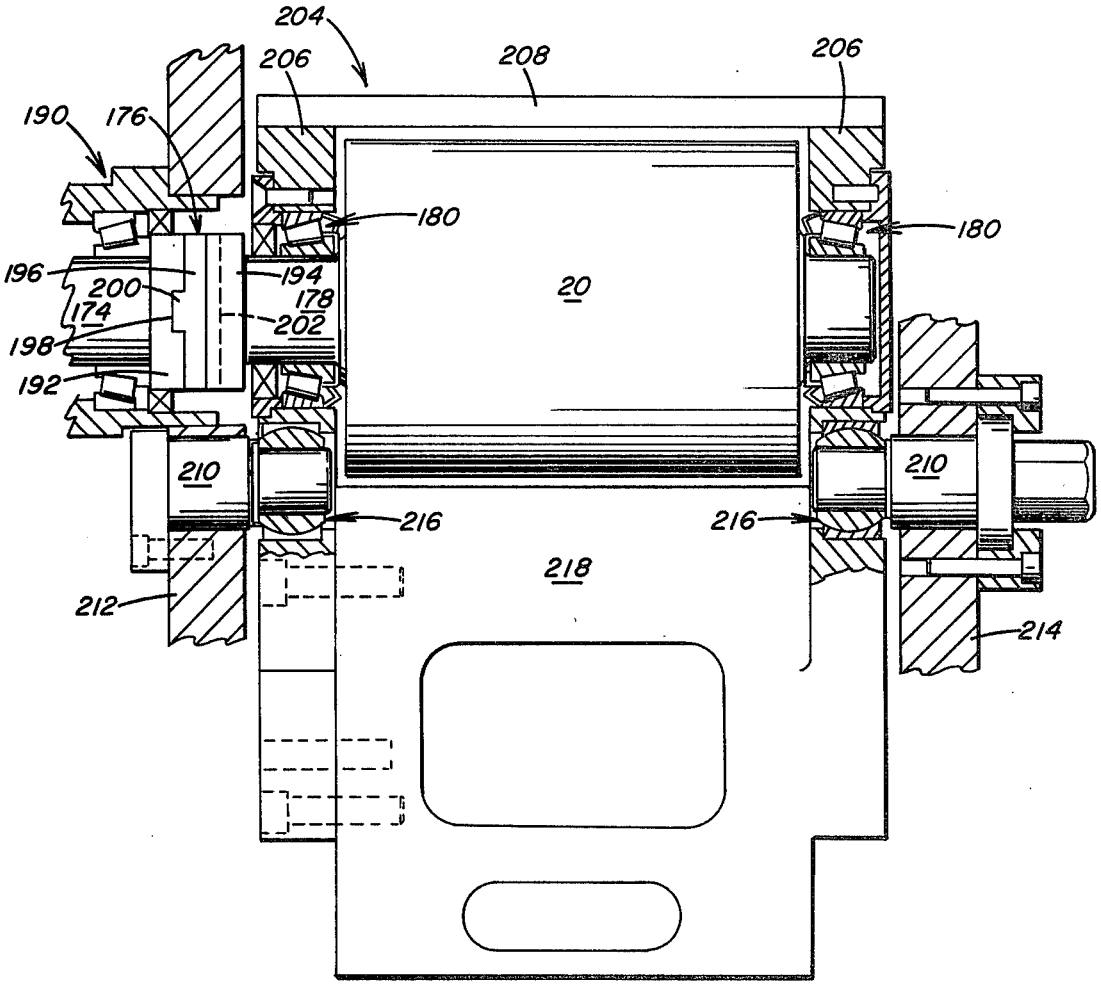
FIG. 5 is a partial, sectional, fragmentary view, in side elevation, of a pivotal support frame for the lower feed roll, illustrating the lower feed roll drivingly connected to a coupling for transmitting oscillatory rotational movement to the lower feed roll as it is moved toward and away from the upper feed roll.

A gear 170 is mounted on the upper feed roll shaft 162. Both the gears 160 and 170 are secured to the shaft 162 in the manner illustrated in FIG. 1 to prevent axial movement of the gears on the shaft 162. The gear 170 is drivingly connected to a lower feed roll drive gear 172 that is mounted on a shaft 174 of a drive coupling generally designated by the numeral 176 for transmitting oscillatory rotational movement from the upper feed roll shaft 162 to a lower feed roll shaft 178. The lower feed roll shaft 178 is rotatably supported in the housing 12 by bearing assemblies 180, in a manner as illustrated in FIG. 5. The lower feed roll 20 is nonrotatably connected to the shaft 178 so that the oscillatory rotational movement of the shaft 178 is also transmitted to the lower feed roll 20. The lower feed roll drive gear 172 is retained axially fixed on the coupling shaft 174 between a shaft shoulder 182 and the lock nut washer combination 184. The shaft 174 includes an outer end portion 186 that is rotatably supported in a bearing housing generally designated by the numeral 188 that is secured to the gear case frame 142. The shaft 174 is also rotatably supported in a bearing housing 190 secured to the main housing 12.

In accordance with the present invention, the drive coupling 176 is operable to transmit oscillatory rotational movement to the lower feed roll shaft 178 and the lower feed roll 20 as the lower feed roll 20 is moved toward and away from the upper feed roll 18. This occurs when the upper and lower feed rolls 18 and 20 are moved into and out of feeding engagement with the stock material positioned between the upper end lower feed rolls 18 and 20.

The drive coupling 176 includes a pair of end discs 192 and 194 and a center disc 196. The end disc 192 is nonrotatably connected to the shaft 174 and the end disc 194 is nonrotatably connected to the lower feed roll shaft 178. The center disc 196 connects the end discs 192 and 194 in a manner to permit transmission of rotation from the shaft 174 to the shaft 178 while permitting lateral pivotal movement of the shaft 178 together with the lower feed roll 20 relative to the shaft 174 which remains fixed. This is accomplished by keying the center disc 196 to the end discs 192 and 194 to permit sliding rotational movement of the center disc 196 relative to the end discs 192 and 194. Thus, the end disc 192 is drivingly connected by the center disc 196 to the end disc 194 for transmission of rotation from shaft 174 to shaft 178 while permitting pivotal movement of the shaft 178 relative to the fixed shaft 174 as rotation is transmitted from the shaft 174 to the shaft 178.

As illustrated in FIG. 5, the end disc 192 includes a keyway 198 for receiving a key 200 of the center disc 196. In a similar arrangement, the opposite end disc 194 includes a keyway (not shown) for receiving an opposite key 202 of the center disc. The keys 200 and 202 of the center disc 196 are positioned in the respective keyways of the end discs 192 and 194 to permit the respective discs to rotate relative to one another as well as pivot laterally to one another. The shaft 174 connected to the end disc 192 has a rotational axis displaced laterally from the rotational axis of the lower feed roll shaft 178 which is connected to the end disc 194. It should be understood, however, that the drive coupling discs may be also connected in a manner whereby the shafts 174 and 178 are coaxially aligned, as well as, being positioned in spaced parallel relation.

Referring to FIG. 5, there is shown the feed roll shaft 178 of the lower feed roll 20 rotatably supported by the bearing assemblies 180 for rotation within a frame 204 which includes a pair of arms 206 connected to a tie bar 208, thereby forming the frame 204. The arms 206 are mounted by trunnions 210 for pivotal movement in walls 212 and 214 of the machine housing 12. The trunnions 210 are rotatably supported within the arms 206 of the frame 204 by spherical universal bearings 216 to permit rotation of the trunnions 210 relative to the arms 206 and also permit the axes of the trunnions 210 to be pivoted. The arms 206 are also connected at their lower end portions to a lever portion 218 of the frame 204. Thus, with this arrangement, when an actuating force is applied to the lever portion 218, the frame 204 pivots about the axes of the trunnions 210 to move the lower feed roll 20 toward and away from the upper feed roll 18. Pivotal movement of the frame 204 and the lever portion 218 is actuated by upward movement of a lift bale generally designated by the numeral 220 in FIG. 1.

The lift bale 220 includes a central body portion 222 connected by a pin 224 to an end 226 of a bale release rod 228. A pair of arm members 230 and 232 extend downwardly from opposite ends of the bale central body portion 222 and are pivotally connected by pins 234 and 236 respectively to the lever portion 218 of the pivotal frame 204. The lever portion 218 is also connected, as illustrated in FIG. 1, by a pin 238 to the enlarged end 240 of a piston rod 242 of a piston cylinder assembly 244. The piston cylinder assembly 244 is mounted by trunnions 246 to a support frame 248 bolted to the main housing 12.

The piston cylinder assembly 244 is operable to exert a downwardly directed force upon the frame lever portion 218 so that the frame 204 is normally positioned to support the lower feed roll 20 in the workpiece engaging or feeding position relative to the upper feed roll 18. The lower feed roll 20 is pivoted out of the position for feeding stock material to the press by operation of the lift bale 220 and a feed release mechanism generally designated by the numeral 250 in FIG. 1. The piston rod 242 is extended from the piston cylinder 244 during the feed release operation. Accordingly, when the lower feed roll 20 is pivoted back into the feeding position relative to the feed roll 18, the piston rod 242 is retracted. The piston cylinder assembly 244 pivots on the support frame 248 to facilitate extension and retraction of the piston rod 242 as the frame 204 pivots the lower feed roll 20 into and out of the feed position.

The feed release mechanism 250 includes the lift bale 220 and the connection of the lift bale 220 to the pivotal frame 204 of the lower feed roll 20. A lift arm 252 is pivotally connected by a shaft 254 to a support plate 256 that is bolted to the main frame 12. The lift arm 252 includes a first end portion 258 that carries a cam follower 260 and a second end portion 262 connected to an upper end 264 of the bale release rod 228. With this arrangement, the lift arm 252 pivots on the shaft 254. The pivotal movement of shaft 254 is actuated by the cam follower 260 contacting the surface of a roll release cam 266 that is nonrotatably connected to the input shaft 14. Thus, the roll release cam 266 rotates continuously with the input shaft 14. With this arrangement, continuous rotation of the input shaft 14 is converted to rocking or pivotal motion of the lift arm 252 by contact of the cam follower 260 with the roll release cam 266.

Pivoting of the lift arm 252 on the shaft 254 raises and lowers the arm end portion 262 to, in turn, raise and lower the bale release rod end portion 264. Upward movement of the bale release rod 228 actuates upward movement of the bale 220 and pivots the frame lever portion 218 about the pivot pins 234 and 236. The frame 204 pivots on the walls 212 and 214 illustrated in FIG. 5 so that the feed roll shaft 178 and the lower feed roll 20 are lowered or moved away from the upper feed roll 18. When the lower feed roll 20 is lowered, the stock material positioned between the feed rolls 18 and 20 is free for adjustment on the dies of the punch press for the next punching stroke.

As the feed roll 20 is lowered, the piston rod 242 is extended from the piston cylinder assembly 244. Accordingly, as the cam follower 260 follows the surface of tne roll release cam 266, the bale lift arm 252 is pivoted downwardly to lower the bale release rod 228. The bale 220 is thus lowered to pivot the frame 204 in the opposite direction so that the lower feed roll shaft 178 and the lower feed roll 20 are returned to the position for feeding another incremental length of stock material to the press.

In operation, for example during rotation of the driven feed rolls 18 and 20 in the direction of feed and through a fixed angle of rotation of the cam follower shaft 56, for example 60°, a preselected length of stock material is fed by rotation of both driven feed rolls 18 and 20. After completion of the angular movement of the driven feed rolls 18 and 20, a first dwell period occurs during which time the driven feed rolls 18 and 20 are released from feeding engagement with the stock material by operation of the above described feed release mechanism 250. A clamping mechanism generally designated by the numeral 268 and illustrated in FIG. 1 is actuated to prevent movement of the stock material as the driven feed rolls 18 and 20 are rotated back to the initial feed position. The feed rolls 18 and 20 are rotated back through a preselected angle of rotation and a second dwell period occurs, during which time the clamping mechanism 268 is released from engagement with the stock material. The driven feed roll 20 is then pivoted back into the feeding position relative to the other driven feed roll 18 for feeding another increment of stock material to the press.

The clamping operation is actuated by the contact of a cam follower 278 with the surface of a clamp release cam 280 illustrated in FIG. 2. The clamp release cam 280 is nonrotatably connected to the input shaft 14 to rotate continuously with the input shaft 14. The clamp release cam 280 and the feed roll release cam 266 have a preselected cam configuration so that the feeding of the stock material to the press is synchronized with the engagement of the driven feed rolls 18 and 20 with the stock material and release of the clamping mechanism 268 from engagement with the stock material.

The cam follower 278 is carried by a lift arm 281 which is also pivotally mounted on the shaft 254. A clamp cylinder adjusting screw 282 is connected to the opposite end of the lift arm 281. The adjusting screw 282 abuts the top surface of a pressure disc 288 of an air actuated clamp cylinder 290. An extensible rod 292 of the cylinder 290 is connected to a clamp shoe 294. The clamp shoe 294 is arranged to move into and out of clamping engagement with the stock material as the stock material is fed between a pair of guide plates 296 and 298. The clamp shoe 294 is shown in a raised position in FIG. 1 and is lowered upon downward pivotal movement of the clamp lift arm 281 and the pressure exerted on the pressure disc 288 by the adjusting screw 282.

The stock material is supported for longitudinal movement on the lower guide plate 298 and when the adjusting screw 282 is lowered, the clamp shoe 294 engages the stock material on the lower guide plate 298 to prevent feeding of the stock material during the punching operation. Accordingly, when the clamp shoe 294 is raised, the stock material is free to be fed to the punch press for punching of the next increment of the stock material. A spring return mechanism generally designated by the numeral 300 is operable to return the clamp shoe 294 to the raised position which is removed from engagement with the stock material after the clamping cycle is completed upon continued rotation of the clamp release cam 280. The clamping operation is synchronized with the commencement of the feed cycle and movement of the lower feed roll toward the upper feed roll 18 so that both driven feed rolls 18 and 20 engage the stock material. The details of the clamping mechanism 268 are set forth in greater detail in U.S. Pat. No. 4,316,569.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for intermittently feeding a workpiece comprising, an input shaft supported for rotation at a continuous preselected speed, an output shaft having a first end portion and a second end portion, cam drive means drivingly connecting said output shaft first end portion to said input shaft for generating oscillating rotational movement of said output shaft through a preselected angle of rotation, feed means for intermittently feeding a preselected length of the workpiece in a selected direction, said feed means including a first feed roll and a second feed roll, a frame for supporting said first and second feed rolls in overlying relation to engage the workpiece therebetween, rotation transmission means drivingly connected at one end to said output shaft second end portion and at an opposite end to said first feed roll, said rotation transmission means being operable to transmit the oscillating rotational movement of said output shaft to said first feed roll to oscillate said first feed roll through said preselected angle of rotation, pivot means for supporting said second feed roll in said frame for movement toward and away from said first feed roll, coupling means for drivingly connecting said rotation transmission means to said second feed roll to oscillate said second feed roll through an angle of rotation corresponding to the angle of rotation of said first feed roll and thereby drive both said first and second feed rolls, and said coupling means drivingly connected to said second feed roll to facilitate movement of said second feed roll toward and away from said first feed roll as rotation is transmitted to said second feed roll.

2. Apparatus as set forth in claim 1 in which, said first feed roll is positioned above said second feed roll, said rotation transmission means including a gear cluster drivingly connected to said coupling means to transmit rotation of said first feed roll to said second feed roll, and said coupling means connected to said gear cluster to facilitate lateral movement of said second feed roll relative to said first feed roll as rotation is transmitted from said first feed roll to said second feed roll.

3. Apparatus as set forth in claim 1 which includes, a first drive shaft fixed to said first feed roll, a second drive shaft fixed to said second feed roll, said rotation transmission means being drivingly connected to said first drive shaft to transmit said oscillating rotational movement to said first feed roll, and said coupling means being drivingly connected at one end to said first drive shaft and at the opposite end to said second drive shaft to transmit said oscillating rotational movement from said first drive shaft to said second drive shaft and said second feed roll.

4. Apparatus as set forth in claim 1 which includes, a drive shaft fixed to said second feed roll, said pivot means pivotally supporting said drive shaft in said frame, and feed roll release means connected to said pivot means for actuating pivotal movement of said pivot means on said frame to move said second feed roll toward and away from said first feed roll to move said first and second feed rolls into and out of feeding engagement with the workpiece.

5. Apparatus as set forth in claim 4 which includes, a drive shaft fixed to said second feed roll, said coupling means drivingly connecting said rotation transmission to said drive shaft for lateral movement of said drive shaft relative to said first feed roll as said oscillating rotational movement is transmitted to said second feed roll, said pivot means including a lever arm for rotatably supporting said drive shaft, and universal bearing means for supporting said lever arm on said frame for pivotal movement of said lever arm whereby said second feed roll is moved laterally toward and away from said first feed roll.

6. Apparatus as set forth in claim 1 in which, said coupling means includes a first shaft and a second shaft, sliding disc means for rotatably connecting said first shaft to said second shaft whereby said second shaft is movable laterally relative to said first shaft as said oscillating rotational movement is transmitted from said first shaft to said second shaft, and said first shaft being drivingly connected to said rotation transmission means and said second shaft being drivingly connected to said second feed roll.

7. Apparatus as set forth in claim 1 which includes, a first drive shaft fixed to said first feed roll, said first drive shaft being rotatably supported in said frame, said first drive shaft being drivingly connected to said rotation transmission means, a second drive shaft fixed to said second feed roll, said second drive shaft being rotatably supported by said pivot means, said coupling means rotatably connecting said first drive shaft to said second drive shaft, said coupling means including means for rotatably connecting said second drive shaft for lateral movement relative to said first drive shaft, and actuating means connected to said pivot means for pivoting said pivot means on said frame to laterally oscillate said second drive shaft together with said second feed roll relative to said first feed roll which remains fixed.

8. Apparatus as set forth in claim 1 which includes, a first drive shaft fixed to said first feed roll, a second drive shaft fixed to said second feed roll, and said second drive shaft carried by said pivot means for lateral oscillating movement relative to said first drive shaft to move said second feed roll into and out of a workpiece feeding position relative to said first feed roll.

9. Apparatus as set forth in claim 1 which includes, a drive shaft fixed to said second feed roll, said drive shaft being rotatably supported by said pivot means, and said pivot means universally connected to said frame to permit pivotal movement of said drive shaft and said second feed roll relative to said first feed roll.

10. Apparatus as set forth in claim 9 in which, said coupling means includes a shaft portion drivingly connected to said rotation transmission means, and sliding disc means drivingly connecting said shaft portion to said second feed roll drive shaft to permit lateral oscillating movement of said second feed roll drive shaft as said oscillating rotational movement is transmitted thereto.

* * * * *